US010154355B2

(12) United States Patent
Udesen et al.

(10) Patent No.: US 10,154,355 B2
(45) **Date of Patent: *Dec. 11, 2018**

(54) HEARING DEVICE WITH POSITION DATA AND METHOD OF OPERATING A HEARING DEVICE

(71) Applicant: GN HEARING A/S, Ballerup (DK)

(72) Inventors: Jesper Udesen, Malov (DK); Adam Weisser, Ballerup (DK)

(73) Assignee: GN HEARING A/S, Ballerup (DK)

( * ) Notice: Subject to any disclaimer, the term of this patent is extended or adjusted under 35 U.S.C. 154(b) by 53 days.

This patent is subject to a terminal disclaimer.

(21) Appl. No.: 14/579,308

(22) Filed: Dec. 22, 2014

(65) Prior Publication Data

US 2015/0189453 A1 Jul. 2, 2015

(30) Foreign Application Priority Data

Dec. 30, 2013 (DK) ..... 2013 70827
Dec. 30, 2013 (EP) ..... 13199856

(51) Int. Cl.
*H04R 25/00* (2006.01)

(52) U.S. Cl.
CPC ..... *H04R 25/554* (2013.01); *H04R 25/43* (2013.01); *H04R 25/552* (2013.01);
(Continued)

(58) Field of Classification Search
CPC .. H04R 2460/07; H04R 5/02; H04R 2225/55; H04R 25/43; H04R 25/552;
(Continued)

(56) References Cited

U.S. PATENT DOCUMENTS 6,845,338 B1 1/2005 Willins et al.
7,072,480 B2 * 7/2006 Rass ..... H04R 25/407 381/314

(Continued)

FOREIGN PATENT DOCUMENTS

CN 1684550 A 10/2005
CN 101142851 A 3/2008

(Continued)

OTHER PUBLICATIONS

Extended European Search Report dated Apr. 2, 2014, for related EP Patent Application No. 13199856.9, 6 pages.

(Continued)

*Primary Examiner* — Oyesola C Ojo
(74) *Attorney, Agent, or Firm* — Vista IP Law Group, LLP

(57) ABSTRACT

A hearing device includes: a first antenna; a first transceiver coupled to the first antenna and configured to wirelessly receive one or more audio streams from an audio system, the one or more audio streams including a first audio stream; a primary processing unit; an acoustic output transducer coupled to an output of the primary processing unit; a secondary processing unit with a first input coupled to an output of the first transceiver for receiving a first wireless input signal representative of the first audio stream from the first transceiver; a position controller for determining position data, the position controller having an output for sending a position control signal to the secondary processing unit; and at least one microphone coupled to the secondary processing unit; wherein the secondary processing unit is configured to process the first wireless input signal from the first transceiver based on the position control signal.

14 Claims, 5 Drawing Sheets

(52) U.S. Cl.
CPC ..... *H04R 2225/41* (2013.01); *H04R 2225/51* (2013.01); *H04R 2225/55* (2013.01); *H04R 2460/07* (2013.01)

(58) Field of Classification Search
CPC ..... H04R 2460/03; H04R 25/554; H04R 2225/021; H04R 2225/023; H04R 2225/025
USPC ..... 381/315, 313
See application file for complete search history.

(56) References Cited

U.S. PATENT DOCUMENTS

| | | | | |
|---|---|---|---|---|
| 9,078,070 | B2 * | 7/2015 | Samuels | H04R 25/00 |
| 9,374,647 | B2 * | 6/2016 | Han | H04R 25/50 |
| 9,565,502 | B2 * | 2/2017 | Pontoppidan | H04R 25/552 |
| 2004/0156512 | A1 * | 8/2004 | Parker | H04R 5/033 381/74 |
| 2005/0094834 | A1 | 5/2005 | Chalupper | |
| 2008/0008342 | A1 | 1/2008 | Sauk | |
| 2008/0080705 | A1 | 4/2008 | Gerhardt et al. | |
| 2008/0165994 | A1 * | 7/2008 | Caren | H04R 25/554 381/312 |
| 2009/0052703 | A1 * | 2/2009 | Hammershoi | H04S 7/302 381/310 |
| 2010/0189293 | A1 | 7/2010 | Imamura et al. | |
| 2011/0293123 | A1 | 12/2011 | Neumeyer et al. | |
| 2011/0299707 | A1 | 12/2011 | Meyer | |
| 2013/0094683 | A1 * | 4/2013 | Hansen | G09B 21/04 381/309 |
| 2013/0177187 | A1 | 7/2013 | Mentz | |
| 2013/0315425 | A1 * | 11/2013 | Lunner | H04R 25/00 381/323 |
| 2013/0316679 | A1 | 11/2013 | Miller et al. | |
| 2013/0343584 | A1 * | 12/2013 | Bennett | H04R 25/554 381/315 |
| 2014/0056452 | A1 * | 2/2014 | Moss | H04R 25/30 381/323 |
| 2015/0003653 | A1 * | 1/2015 | Recker | H04R 25/40 381/315 |
| 2015/0124975 | A1 * | 5/2015 | Pontoppidan | H04R 25/552 381/23.1 |
| 2015/0189449 | A1 | 7/2015 | Udesen | |

FOREIGN PATENT DOCUMENTS

| | | | |
|---|---|---|---|
| CN | 103118321 | A | 5/2013 |
| EP | 1 638 367 | A2 | 3/2006 |
| EP | 2 584 794 | A1 | 4/2013 |
| EP | 2 675 189 | A1 | 12/2013 |
| WO | WO 2007/112756 | A2 | 10/2007 |
| WO | WO 2007/112756 | A3 | 10/2007 |
| WO | WO 2009/118424 | A2 | 10/2009 |
| WO | WO 2012/177139 | A2 | 12/2012 |

OTHER PUBLICATIONS

First Technical Examination and Search Report dated Aug. 15, 2014, for related Danish Patent Application No. PA 2013 70827, 6 pages.
Extended European Search Report dated Mar. 27, 2014, for related European Application No. 13199857.7, 7 pages.
First Danish Office Action and Search Report dated Sep. 12, 2014, for related Danish Patent Application No. PA 2013 70828, 4 pages.
Non-final Office Action dated Jun. 24, 2016 for related U.S. Appl. No. 14/576,160.
Final Office Action dated Feb. 24, 2017 for related U.S. Appl. No. 14/576,160.
Advisory Action dated Aug. 8, 2017 for related U.S. Appl. No. 14/576,160.
Notice of Allowance and Fee(s) due dated Sep. 11, 2017 for related U.S. Appl. No. 14/576,160.
First Office Action dated Aug. 1, 2018 for corresponding Chinese Patent Application No. 201410841044.7.

* cited by examiner

HEARING DEVICE WITH POSITION DATA AND METHOD OF OPERATING A HEARING DEVICE

RELATED APPLICATION DATA

This application claims priority to and the benefit of Danish Patent Application No. PA 2013 70827 filed on Dec. 30, 2013, pending, and European Patent Application No. 13199856.9 filed on Dec. 30, 2013, pending. The entire disclosures of both of the above applications are expressly incorporated by reference herein.

FIELD

The present disclosure relates to a hearing device and a method of operating a hearing device. In particular, the present disclosure relates to a hearing device with position data and related method for improving the correspondence of the visual and the auditory cues of a hearing aid user in a crowded environment.

BACKGROUND

It is known to stream audio to hearing devices via a telecoil solution having a limited bandwidth with limited possibilities of separating different audio streams. Further, wireless communication to and from hearing devices has been increasing in continuation of the developments within wireless communication technology. In an environment where audio is distributed to the crowd via a number of external microphones or other audio sources the present technology provides limited possibilities of separating audio signals from different positions.

SUMMARY

There is a need for a hearing device that improves separation of audio signals from different audio sources in an audio system.

Despite the known solutions there is still a need for improved user experience in a crowded area with multiple microphones/audio sources.

Accordingly, a hearing device is provided, the hearing device comprising a first antenna, a first transceiver coupled to the first antenna and configured to wirelessly receive one or more audio streams from an audio system, the one or more audio streams including a first audio stream; a primary processing unit adapted for processing an input signal according to a hearing prescription in order to alleviate a hearing loss; an acoustic output transducer coupled to an output of the primary processing unit for conversion of an output signal from the primary processing unit into an audio output signal; at least one microphone; a secondary processing unit with a first input coupled to an output of the first transceiver for receiving a first wireless input signal representative of the first audio stream from the first transceiver; and a position controller for detecting position data of the hearing device, the position controller having an output coupled to a position input of the secondary processing unit for sending a position control signal to the secondary processing unit; wherein the secondary processing unit is configured to process the first wireless input signal from the first transceiver based on the position control signal.

Also disclosed is a method for operating a hearing device, the method comprising: receiving a first audio stream; converting the first audio stream to a first wireless input signal; determining position data of the hearing device; processing the first wireless audio signal based on the position data of the hearing device to form an output signal; and converting the output signal to an audio output signal.

It is an advantage that processing of wireless input signal(s) in the hearing device is based on the position (direction and/or distance) of the hearing device, thereby improving the user experience of the hearing device. Thus, the position (distance and/or orientation) of the hearing device may provide prioritization of input signals.

Further, the disclosed hearing aid and methods improve the correspondence of the visual and the auditory cues of the listener, otherwise lost in crowd amplification.

The primary processing unit and/or the secondary processing unit of the hearing device may be configured to compensate for hearing loss or hearing disability of the user of the hearing device. The primary processing unit and/or the secondary processing unit of the hearing device may be configured to alter a received audio stream, e.g. the first audio stream, a wireless input signal, e.g. the first wireless input signal, and/or the input signal to compensate for hearing loss or hearing disability of the user of the hearing device.

The hearing device comprises a secondary processing unit and a primary processing unit. The secondary processing unit and the primary processing unit may be embedded as a single processing unit performing the tasks of both the secondary processing unit and the primary processing unit.

A hearing device includes: a first antenna; a first transceiver coupled to the first antenna and configured to wirelessly receive one or more audio streams from an audio system, the one or more audio streams including a first audio stream; a primary processing unit configured to perform signal processing according to a hearing prescription to alleviate a hearing loss; an acoustic output transducer coupled to an output of the primary processing unit for conversion of an output signal from the primary processing unit into an audio output signal; a secondary processing unit with a first input coupled to an output of the first transceiver for receiving a first wireless input signal representative of the first audio stream from the first transceiver; a position controller for determining position data of the hearing device, the position controller having an output for sending a position control signal to the secondary processing unit; and at least one microphone coupled to the secondary processing unit; wherein the secondary processing unit is configured to process the first wireless input signal from the first transceiver based on the position control signal.

Optionally, the position controller comprises a motion detector, and a position processing unit connected to the motion detector and configured to determine the position data of the hearing device based on an output from the motion detector.

Optionally, the position data comprises angular position data of the hearing device, and wherein the position control signal is based on the angular position data of the hearing device.

Optionally, the hearing device is configured to determine a first gain for application to the first wireless input signal based on the position data of the hearing device.

Optionally, the one or more audio streams includes a second audio stream, and wherein the secondary processing unit is configured to receive a second wireless input signal representative of the second audio stream from the first transceiver, and process the second wireless input signal based on the position control signal.

Optionally, the hearing device is configured to determine a second gain for application to the second wireless input signal based on the position data of the hearing device.

Optionally, the hearing device further includes a second antenna connected to the position controller for communication with the audio system.

Optionally, the position controller is configured for receiving audio system position data, and wherein the position control signal is based on the audio system position data.

Optionally, the at least one microphone includes a first microphone for receiving an acoustic audio signal and converting the acoustic audio signal to an audio input signal, the first microphone coupled to a second input of the secondary processing unit and configured to provide the audio input signal to the secondary processing unit, and wherein the secondary processing unit is configured to process the audio input signal based on the position control signal.

A method for operating a hearing device includes: receiving a first audio stream; converting the first audio stream to a first wireless input signal; determining position data of the hearing device; processing the first wireless audio signal based on the position data of the hearing device to form an output signal; and converting the output signal to an audio output signal.

Optionally, the method further includes receiving an acoustic audio signal; and converting the acoustic audio signal to an audio input signal; wherein the output signal is formed by processing the audio input signal and the first wireless audio signal based on the position data of the hearing device.

Other features and embodiments will be described below in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
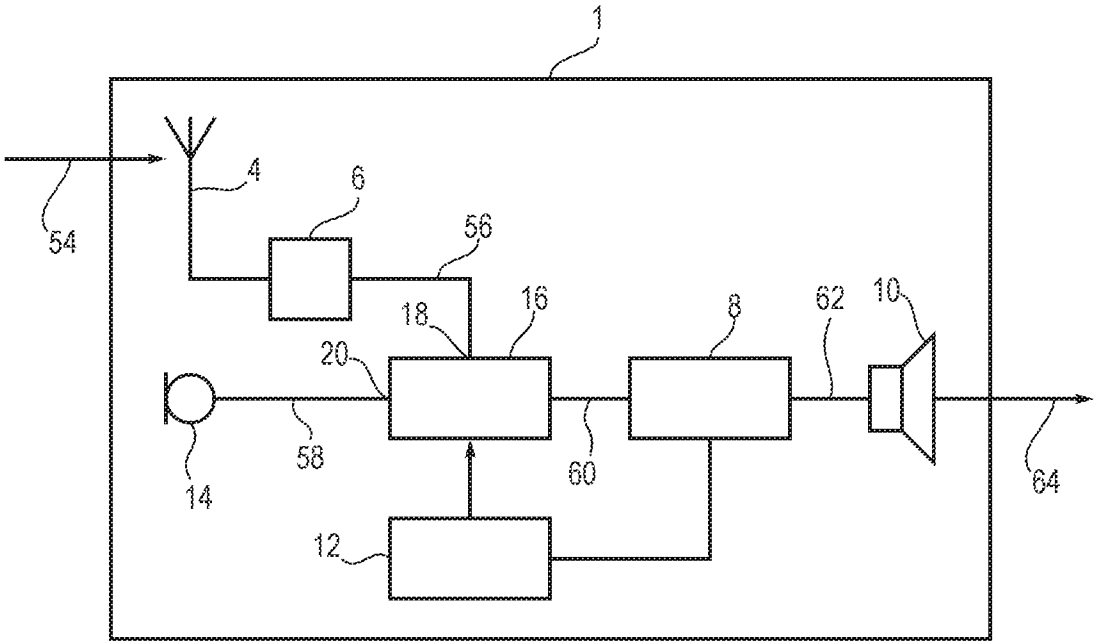
FIG. 1 schematically illustrates an exemplary hearing device.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to a hearing device and a method enabling adaptation of signal processing in the hearing device based on position data of the hearing device and/or position data of an audio system comprising one or more audio sources.

The hearing device comprises a first transceiver coupled to the first antenna and configured to wirelessly receive one or more audio streams from an audio system, the one or more audio streams including a first audio stream. The first transceiver may be configured to receive and/or sent position data of the audio system and/or the hearing device.

The hearing device comprises a position controller for detecting position data of the hearing device. The position controller has an output coupled to a position input of the secondary processing unit for sending a position control signal to the secondary processing unit. The position controller may comprise a motion detector and a position processing unit connected to the motion detector. The position processing unit is configured to estimate position data of the hearing device based on motion sensor output. The motion detector may comprise one or a plurality of sensors e.g. one or more gyroscopes and/or one or more accelerometers.

The position controller may be configured for determining a position control signal based on the position data of the hearing device. The position controller may comprise a position port and may be configured to receive audio system position data and/or send hearing device position data via the position port. Accordingly, the position controller may be configured for receiving audio system position data, and the position control signal may be based on the audio system position data. The position port may be coupled to the first transceiver and/or second transceiver. Thus, the position controller may be configured to determine and send position control signal based on audio system position data received via the position port. The position controller may comprise a control port for coupling to the primary processing unit for exchange of control signals.

The position data of the hearing device may comprise angular position data of the hearing device, and the position control signal is based on angular position data of the hearing device.

For example, the position data may comprise information of the azimuth angle of the hearing device. The azimuth angle may be indicative of the looking direction of the user wearing the hearing device. Alternatively, or additionally, the position data may comprise information of the altitude angle.

The position data may comprise distance position data of the hearing device. For example, the position data may comprise information of the distance of the hearing device relative to an audio source and/or a reference point.

The secondary processing unit is configured to process input signal(s) such as audio input signal and/or wireless input signal(s) depending on the position control signal.

The position control signal may select the value(s) of gain(s) applied to input signal(s) to the secondary processing unit. Thus the position control signal may be indicative of gain(s) to be applied to input signal(s) to the secondary processing unit. Accordingly, the position control signal may select a value of a first gain to be applied to the first wireless input signal based on the position data of the hearing device.

The one or more audio streams may include a second audio stream that is converted to a second wireless input signal in the first transceiver. The secondary processing unit may be configured to process the second wireless input signal from the first transceiver based on the position control signal. The position control signal may select a value of a second gain to be applied to the second wireless input signal based on the position data of the hearing device. The secondary processing unit may apply a second gain to the second wireless input signal based on the position control signal from the position controller.

The hearing device may comprise a second antenna and/or a second transceiver connected to the position controller for receiving and/or sending position data from/to an audio system.

The at least one microphone may include a first microphone for receiving an acoustic audio signal and converting the acoustic audio signal to an audio input signal. The first microphone may have an output coupled to a second input of the secondary processing unit for feeding the audio input signal to the secondary processing unit. The secondary processing unit may be configured to process the audio input signal based on the position control signal. For example, the position control signal may select a value of a microphone gain to be applied to the audio input signal from the first microphone based on the position data of the hearing device.

The method for operating a hearing device comprises receiving a first audio stream and converting the first audio stream to a first wireless input signal. A first audio stream may be converted into a first and a second wireless input signal.

The method comprises determining position data of the hearing device and processing the first wireless audio signal based on the position data of the hearing device to form an output signal. The method may comprise obtaining position data of an audio system and processing the first wireless audio signal based on the position data of the hearing device and the position data of the audio system to form an output signal; and converting the output signal to an audio output signal.

In an audio system, one or more transceivers or transmitter units comprising transceivers are configured for broadcasting or transmitting audio track(s) and/or audio stream(s), e.g. to one or more hearing devices. The audio system may comprise a first transceiver and optionally a second transceiver. A transceiver may transmit one or more audio streams. A transceiver may be identified by a transceiver address. A transmitter unit may be configured to wirelessly transmit audio track(s) and/or audio stream(s).

An audio track is an audible signal. Exemplary audible signals are speech, music, an airport call, a movie sound track or a combination thereof.

An audio stream is an electromagnetic signal representative of an audio track. An audio stream is represented by a number of audio blocks each comprising one or more audio packets. An audio packet comprises a finite part of an audio stream.

An audio packet may comprise an audio stream identifier, which may comprise one or more elements such as audio track identification, transceiver address or identification, audio group identification, audio source identification, etc. Audio track identification may enable selection of audio streams representative of the same audio track, and audio group identification may identify a certain group of audio tracks or audio streams e.g. an audio group may be audio tracks in the same or similar language, e.g. English, Danish or Chinese.

An audio packet may comprise transceiver address of the transceiver transmitting the audio packet, thus enabling the hearing device to sort out or separate audio packets sent from other transceivers.

Transmitting and receiving the wireless audio stream(s) may be achieved by using wireless technology, thus transmitting/receiving audio blocks at one or more frequencies, e.g. in the range from 2.4 GHz to 2.5 GHz, in the range from 800 MHz to 1 GHz, in the range from 3.6 GHz to 3.7 GHz, and/or in the range from 4.9 GHz to 5.9 GHz.

In the hearing device, the primary processing unit may be configured to control the first transceiver. The first transceiver and/or the second transceiver may be configured to receive and/or send audio streams and/or position data at frequencies in the range from 2.4 GHz to 2.5 GHz, in the range from 800 MHz to 1 GHz, in the range from 3.6 GHz to 3.7 GHz, and/or in the range from 4.9 GHz to 5.9 GHz. The first transceiver and/or the second transceiver may be configured to receive audio streams at frequencies in the range from 169 MHz to 218 MHz and/or in the range from 480 MHz to 520 MHz.

The first and/or second transceiver may be configured to transmit and/or receive wirelessly from/to an audio system with one or more audio sources or other external devices, such as other hearing devices, mobile phone.

The hearing device may be configured for pairing the hearing device with an audio system, e.g. with one or more audio sources of the audio system. Pairing may comprise transmitting hearing device information from the hearing device to the audio system. The hearing device information may comprise one or more of hearing device identification, hearing device manufacturer, hearing device model, and/or hearing device configuration data. Pairing of the hearing device with the audio system may additionally or alternatively comprise transmitting audio system information from the audio system to the hearing device and/or receiving audio system information from the audio system. The audio system information may comprise one or more of audio system identification, audio source identification(s), transceiver identification(s) and/or audio stream configuration data. The audio system may be configured to adapt the format of the first audio stream to be sent to the hearing device based on hearing device information received from the hearing device, e.g. model and/or manufacturer, data encoding format etc. Furthermore, pairing of the hearing device with the audio system may comprise exchanging an encryption key, such as to enable encryption of an audio stream, such as the first audio stream, before sending from the audio system, and decryption of the received wireless input signal, e.g. the first wireless input signal, in the hearing device.

Pairing of the hearing device with the audio system may initiate sending of an audio stream, e.g. the first audio stream, from the audio system.

Pairing of the hearing device with the audio system may cause the hearing device to initiate receiving audio stream(s), which is/are sent by the audio system.

The secondary processing unit is configured to process input signal(s) from microphone(s) and/or transceiver(s) to form an input signal to the primary processing unit. The secondary processing unit may apply gain(s) to the input signal(s) and subsequently mix the amplified input signals to form the input signal to the primary processing unit, wherein the gain(s) are controlled by the position controller with the position control signal.

The position controller may be configured to determine a gain or a vector of gains based on position data of the hearing device and/or position data of the audio system.

The first gain $G_1$ may be given by:

$$G_1=f(P_{HD}),$$

where $P_{HD}$ is position data for the hearing device.

In a hearing device with a plurality of input signals, processing of the input signals may comprise applying a vector of gains. The vector of gains may comprise a gain for each of the input signals. The vector of gains $\underline{G}$ may be given by:

$$\underline{G}=\underline{f}(P_{HD})$$

The plurality of gains and/or the first gain may comprise further inputs, such as position data of the audio system:

$$\underline{G}=\underline{f}(P_{HD},P_{AS}),$$

Where $P_{HD}$ is position data for the hearing device, and $P_{AS}$ is position data for the audio system. $P_{AS}$ may be a vector with position data of the audio system.

The position controller may be configured to set the first gain to a first value if a first field of listening (FIL) criterion is fulfilled, i.e. if the position of the hearing aid indicates that the hearing aid user wishes to listen to a first audio source of the audio system. The position controller may be configured to set the first gain to a second value if the first FIL criterion is not fulfilled or if a secondary first FIL criterion is fulfilled. The first value may be larger than the second value.

The first FIL criterion may be based on the first view angle being the angle between the users direction of view and the direction from the hearing device to the first audio source. The first FIL criterion may be given by:

$$|\alpha_1|<T_{1,1},$$

where $\alpha_1$ is the first view angle and $T_{1,1}$ is a first threshold angle for the first audio source. The first threshold angle $T_{1,1}$ may be in the range from 15 to 60 degrees.

The position controller may be configured to set the second gain to a first value if a second field of listening (FIL) criterion is fulfilled, i.e. if the position of the hearing aid indicates that the hearing aid user wishes to listen to a second audio source of the audio system. The position controller may be configured to set the second gain to a second value if the second FIL criterion is not fulfilled or if a secondary second FIL criterion is fulfilled. The first value may be larger than the second value.

The second FIL criterion may be based on the second view angle being the angle between the users direction of view and the direction from the hearing device to the second audio source. The second FIL criterion may be given by:

$$|\alpha_2|<T_{2,1},$$

where $\alpha_2$ is the second view angle and $T_{2,1}$ is a first threshold angle for the second audio source. The first threshold angle $T_{2,1}$ may be in the range from 15 to 60 degrees.

The position controller may be configured to set the microphone gain to a first value if a criterion, such as the first FIL criterion and/or the second FIL criterion, is fulfilled. The position controller may be configured to set the microphone gain to a second value if a criterion, such as the first FIL criterion and/or the second FIL criterion, is not fulfilled. The first value may be less than the second value.

The position controller may be configured to determine a gain or a vector of gains based on an audio input signal from a microphone. Thus, the position controller may be coupled to an output of the first microphone. Accordingly, the gains applied to the input signals may be given by:

$$\underline{G}=\underline{f}(P_{HD},P_{AS},S_{mic}),$$

Where $\underline{G}$ is a vector with gains for the wireless input signal(s) and/or the audio input signal, $P_{HD}$ is position data for the hearing device, $P_{AS}$ is position data from the audio system, and $S_{mic}$ is a control signal received by the microphone. The control signal S received by the microphone may be within a selected frequency range outside the audible range. $P_{AS}$ and/or $S_{mic}$ may be omitted.

FIG. 1 schematically illustrates an exemplary hearing device. The hearing device 1 comprises a first antenna 4 and a first transceiver 6 coupled to the first antenna 4. The first transceiver 6 is configured to wirelessly receive one or more audio streams 54 from an audio system, the one or more audio streams including a first audio stream. Further, the hearing device 1 comprises a primary processing unit 8 adapted for processing an input signal 60 according to a hearing prescription in order to alleviate a hearing loss, an acoustic output transducer 10 coupled to an output of the primary processing unit 8 for conversion of an output signal 62 from the primary processing unit 8 into an audio output signal 64, and at least one microphone including a first microphone 14. The hearing device 1 comprises a secondary processing unit 16 with a first input 18 coupled to an output of the first transceiver 6 for receiving a first wireless input signal 56 representative of the first audio stream from the first transceiver 6, and a position controller 12 for detecting position data of the hearing device, the position controller 12 having an output coupled to a position input of the secondary processing unit for sending a position control signal 66 to the secondary processing unit 16. The secondary processing unit 16 is configured to process the first wireless input signal 56 from the first transceiver 6 based on the position control signal 66. The primary processor 8 may be coupled to the first transceiver 6, e.g. for sending and/or receiving pairing information to/from an audio system. The secondary processing unit 16 has a second input 20 coupled to an output of the first microphone 14 for receiving an audio input signal 58.

The hearing device 1 is configured to pair with an audio system including one or more audio sources. For example, pairing of the hearing device 1 with the one or more audio sources is achieved by pairing the hearing device 1 with the audio system.

The secondary processing unit 16 is configured to process wireless input signal(s) including the first wireless input signal 56 and optionally the audio input signal 58 to form the input signal 60 on an output of the secondary processing unit 16.

The primary processing unit 8 may perform signal processing such as noise reduction, filtering, amplification, etc. of the input signal 60. The primary processing unit 8 may perform signal processing of the input signal 60 to account for hearing disability of the user of the hearing device 1.

Figure 2:
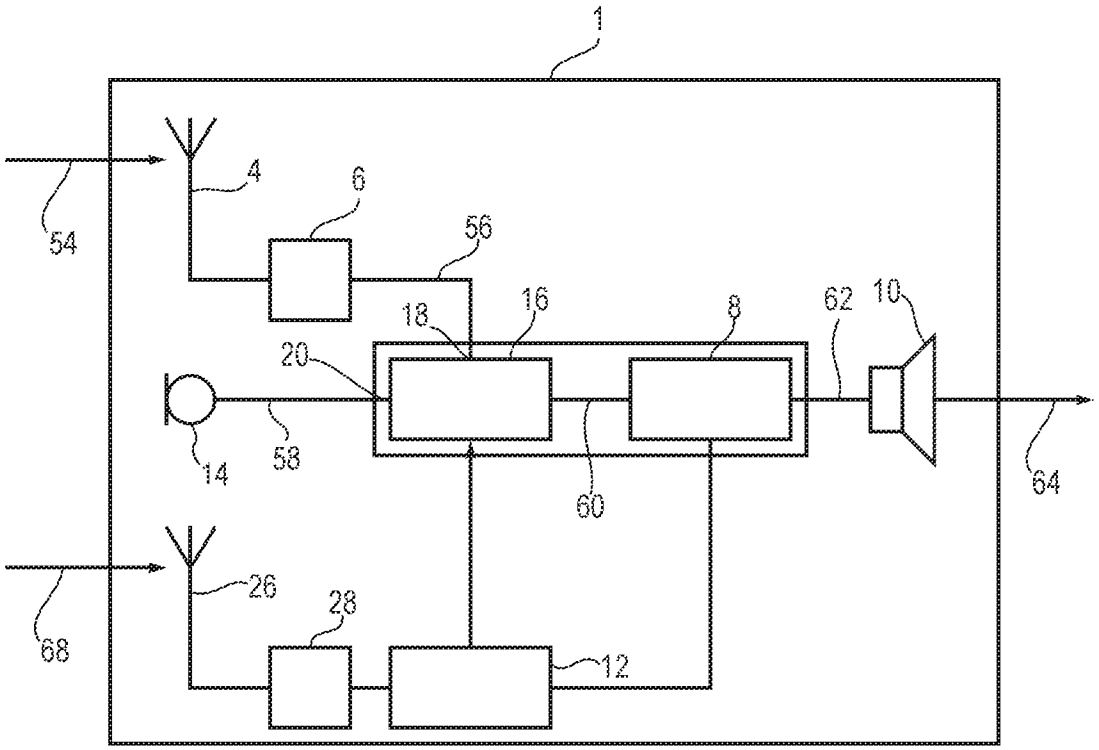
FIG. 2 schematically illustrates an exemplary hearing device.

The secondary processing unit 16 and the primary processing unit 8 may be embedded as a single processing unit as also indicated with the dotted box in FIG. 2.

The position controller 12 is configured for detecting position data of the hearing device. Based on the position data of the hearing device, the position controller 12 determines gain(s) to be applied to the respective input signals to the secondary processing unit 16 and sends position control signal 66 indicative thereof to the secondary processing unit 16. The secondary processing unit processes the input signal(s) including the first wireless input signal from the first transceiver based on the position control signal 66 from the position controller 12. The first transceiver 6 may be coupled to the position controller 12 for receiving audio system position signal 68 indicative of position data of an audio system and/or sending position data of the hearing device to an audio system.

FIG. 2 schematically illustrates an exemplary hearing device. The hearing device 1 comprises a second antenna 26 and a second transceiver 28 coupled to the position controller 12 for receiving audio system position signal 68 indicative of position data of an audio system and/or sending position data of the hearing device to an audio system.

Figure 3:
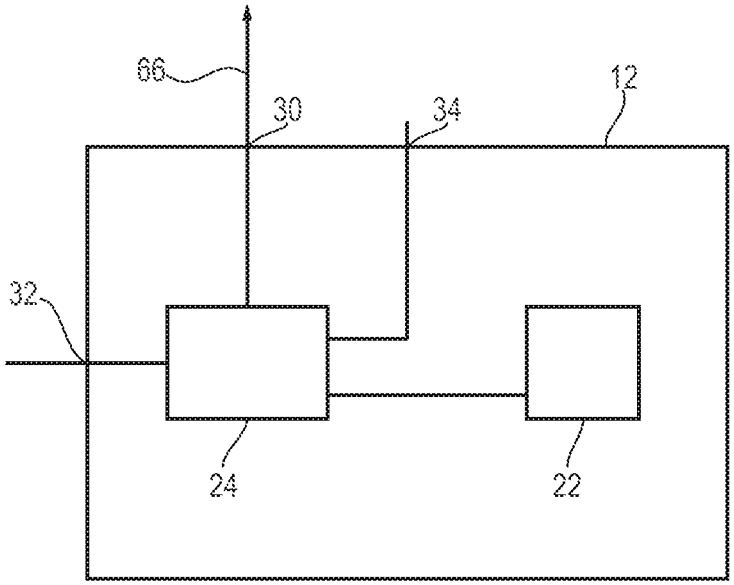
FIG. 3 schematically illustrates an exemplary position controller.

FIG. 3 schematically illustrates an exemplary position controller 12. The position controller 12 is configured for detecting position data of the hearing device 1 and has an output 30 coupled to a position input of the secondary processing unit 16 for sending a position control signal 66 to the secondary processing unit. The position controller 12 comprises a motion detector 22 and a position processing unit 24 configured for estimating position data of the hearing device based on an output of the motion detector 22 and determining a position control signal 66 based on the position data of the hearing device. Optionally, the position controller may be configured to receive audio system position data and/or send hearing device position data via position port 32. The position port 32 may be coupled to the first transceiver 6 and/or second transceiver 28. The position controller 12 may be configured to determine and send position control signal 66 based on audio system position data from first transceiver 6 and/or second transceiver 28. Optionally, the position controller comprises a control port 34 for coupling to the primary processing unit 8 for exchange of control signals.

Figure 4:
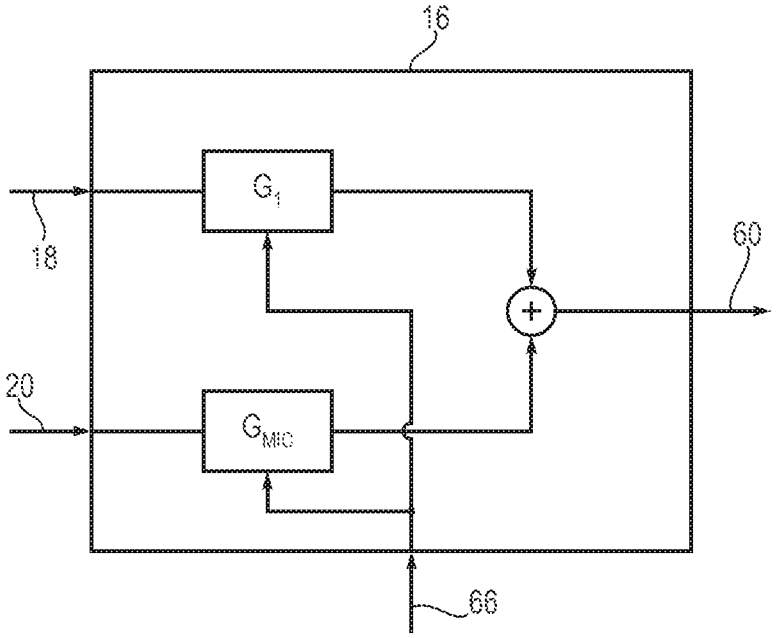
FIG. 4 schematically illustrates an exemplary secondary processing unit.

FIG. 4 illustrates an exemplary secondary processing unit. The secondary processing unit 16 comprises a number of gain units including a first gain unit with adjustable first gain $G_1$ and a microphone gain unit with adjustable microphone gain $G_{mic}$. The first gain $G_1$ applied to the input signal on the first input 18 is controlled by the position control signal 66. The microphone gain $G_{mic}$ applied to the audio input signal on the second input 20 is also controlled by the position control signal 66. The amplified/attenuated signals from the gain units are summed in summation unit to form an input signal 60 to the primary processing unit.

Figure 5:
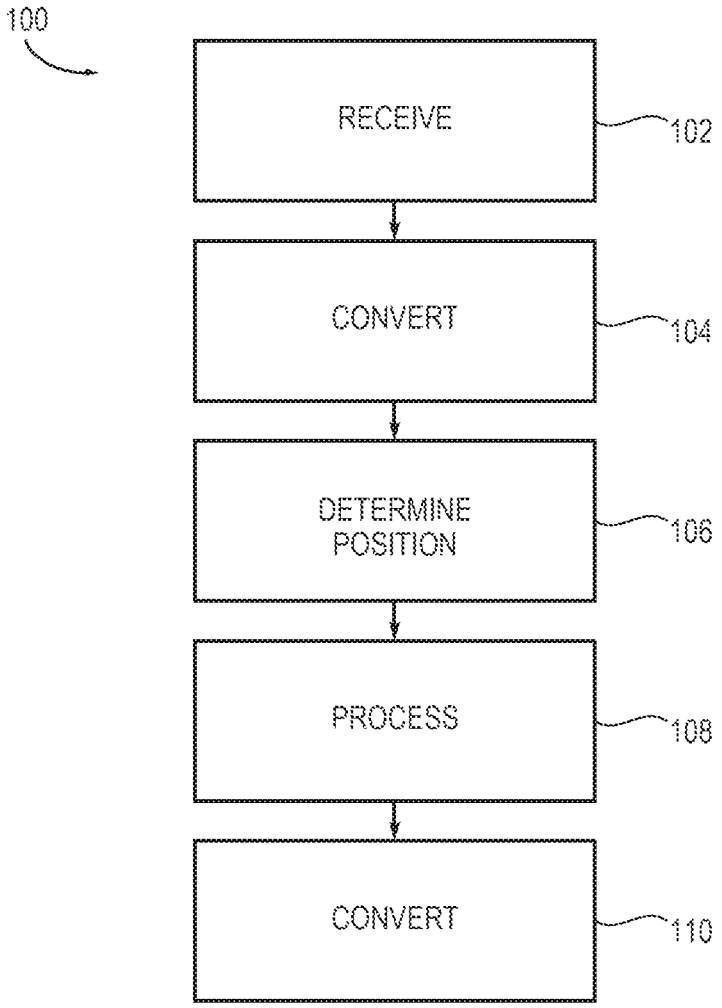
FIG. 5 is a flow diagram for an exemplary method for operating a hearing device.

FIG. 5 is a flow diagram of an exemplary method for operating a hearing device. The method 100 comprises receiving 102 a first audio stream; converting 104 the first audio stream to a first wireless input signal; determining 106 position data of the hearing device; processing 108 the first wireless audio signal based on the position data of the hearing device to form an output signal; and converting 110 the output signal to an audio output signal.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

1 hearing device
4 first antenna
6 first transceiver
8 primary processing unit
10 acoustic output transducer
12 position controller
14 first microphone
16 secondary processing unit
18 first input
20 second input
22 motion detector
24 position processing unit
26 second antenna
28 second transceiver
30 position controller output(s)
32 position port
54 audio stream
56 first wireless input signal
57 second wireless input signal
58 audio input signal
60 input signal
62 output signal
64 audio output signal
66 position control signal
68 audio system position signal
100 method for operating a hearing device
102 receiving audio stream(s)
104 converting audio stream(s) to wireless input signal(s)
106 determining position data of hearing device
108 processing wireless input signal(s) based on position data
110 converting output signal to audio output signal

The invention claimed is:

1. A hearing device comprising:

a first antenna;

a first transceiver coupled to the first antenna and configured to wirelessly receive one or more audio streams from an audio system, the one or more audio streams including a first audio stream;

a primary processing unit configured to perform signal processing according to a hearing prescription to alleviate a hearing loss;

an acoustic output transducer coupled to an output of the primary processing unit for conversion of an output signal from the primary processing unit into an audio output signal;

a secondary processing unit with a first input coupled to an output of the first transceiver for receiving a first wireless input signal representative of the first audio stream from the first transceiver;

a position controller for determining position data of the hearing device, the position controller having an output for sending a position control signal to the secondary processing unit; and at least one microphone coupled to the secondary processing unit;

wherein the secondary processing unit is configured to process both the first wireless input signal from the first transceiver and a microphone-based signal based on the position control signal.

2. The hearing device according to claim 1, wherein the position controller comprises a motion detector, and a position processing unit connected to the motion detector and configured to determine the position data of the hearing device based on an output from the motion detector.

3. The hearing device according to claim 1, wherein the position data comprises angular position data of the hearing device, and wherein the position control signal is based on the angular position data of the hearing device.

4. The hearing device according to claim 1, wherein the hearing device is configured to determine a first gain for application to the first wireless input signal based on the position data of the hearing device.

5. The hearing device according to claim 4, wherein the one or more audio streams includes a second audio stream, and wherein the secondary processing unit is configured to receive a second wireless input signal representative of the second audio stream.

6. The hearing device according to claim 5, wherein the hearing device is configured to determine a second gain for application to the second wireless input signal based on the position data of the hearing device.

7. A hearing device comprising:

a first antenna;

a first transceiver coupled to the first antenna and configured to wirelessly receive one or more audio streams from an audio system, the one or more audio streams including a first audio stream;

a primary processing unit configured to perform signal processing according to a hearing prescription to alleviate a hearing loss;

an acoustic output transducer coupled to an output of the primary processing unit for conversion of an output signal from the primary processing unit into an audio output signal;

a secondary processing unit with a first input coupled to an output of the first transceiver for receiving a first wireless input signal representative of the first audio stream from the first transceiver;

a position controller for determining position data of the hearing device, the position controller having an output for sending a position control signal to the secondary processing unit;

at least one microphone coupled to the secondary processing unit;

wherein the secondary processing unit is configured to process both the first wireless input signal from the first transceiver and a microphone-based signal based on the position control signal; and a second antenna connected to the position controller for communication with the audio system, wherein the first antenna and the second antenna are both associated with the primary processing unit of the hearing device.

8. The hearing device according to claim 1, wherein the position controller is configured for receiving audio system position data, and wherein the position control signal is based on the audio system position data.

9. The hearing device according to claim 1, wherein the at least one microphone includes a first microphone for receiving an acoustic audio signal and converting the acoustic audio signal to an audio input signal, the first microphone coupled to a second input of the secondary processing unit and configured to provide the audio input signal to the secondary processing unit, and wherein the secondary processing unit is configured to process the audio input signal based on the position control signal.

10. The hearing device of claim 1, wherein the secondary processing unit is configured to combine the microphone-based signal with the first wireless input signal.

11. The hearing device of claim 10, wherein the secondary processing unit comprises a first gain unit for applying a first gain to the first wireless input signal to obtain a first adjusted signal.

12. The hearing device of claim 11, wherein the secondary processing unit also comprises a second gain unit for applying a second gain to the microphone-based signal to obtain a second adjusted signal.

13. The hearing device of claim 12, wherein both the first gain unit and the second gain unit are configured to operate based on the position control signal from the position controller.

14. The hearing device of claim 12, wherein the secondary processing unit is configured to combine the microphone-based signal with the first wireless input signal by combining the first adjusted signal with the second adjusted signal.

* * * * *